US005126065A

United States Patent [19]

Tsubouchi et al.

[11] Patent Number: 5,126,065

[45] Date of Patent: Jun. 30, 1992

[54] PROCESS FOR IMPROVING THE COEFFICIENT OF TRACTION AND TRACTION DRIVE FLUID

[75] Inventors: Toshiyuki Tsubouchi; Kazuaki Abe, both of Sodegaura; Hitoshi Hata, Ichihara, all of Japan

[73] Assignee: Idemitsu Kosan Co., Ltd., Tokyo, Japan

[21] Appl. No.: 535,722

[22] Filed: Jun. 11, 1990

[30] Foreign Application Priority Data

Jun. 16, 1989 [JP] Japan ..... 1-152262

[51] Int. Cl.[5] ..... C07C 13/28

[52] U.S. Cl. ..... 252/56 R; 252/49.8; 585/10; 585/20

[58] Field of Search ..... 585/10, 20; 252/56 R, 252/49.8

[56] References Cited

U.S. PATENT DOCUMENTS

| | | | |
|---|---|---|---|
| 2,831,037 | 4/1958 | Schmerling . | |
| 3,411,369 | 11/1968 | Hammann et al. . | |
| 3,440,894 | 4/1969 | Hammann et al. . | |
| 3,763,252 | 10/1973 | Yasui et al. . | |
| 3,843,537 | 6/1971 | Ling et al. . | |
| 3,925,217 | 12/1975 | Green et al. . | |
| 4,675,459 | 7/1987 | Yuasa et al. | 585/21 |

FOREIGN PATENT DOCUMENTS

| | | | |
|---|---|---|---|
| 0082967 | 7/1983 | European Pat. Off. . | |
| 0305807 | 3/1989 | European Pat. Off. . | |
| 2261334 | 9/1975 | France . | |
| 46-338 | 1/1971 | Japan . | |
| 46-339 | 1/1971 | Japan . | |
| 60-115533 | 6/1985 | Japan . | |
| 60-118686 | 6/1986 | Japan . | |
| 61-44918 | 10/1986 | Japan . | |
| 61-230205 | 10/1986 | Japan . | |
| 796133 | 6/1958 | United Kingdom | 260/16 |

*Primary Examiner*—Brian E. Hearn
*Assistant Examiner*—Maria Nuzzolillo
*Attorney, Agent, or Firm*—Frishauf, Holtz, Goodman & Woodward

[57] ABSTRACT

A process for improving the coefficient of traction at high temperatures in a traction drive, and a tranction drive fluid for use therein. This traction drive fluid comprises the hydrogenated product of a dimer, a trimer or a tetramer of norbornanes and/or norbornenes, and exhibits excellent traction performance over a wide temperature range from low temperature to high temperature.

20 Claims, 5 Drawing Steets

PROCESS FOR IMPROVING THE COEFFICIENT OF TRACTION AND TRACTION DRIVE FLUID

BACKGROUND OF THE INVENTION

1. Field of the Invention

The present invention relates to a process for improving the coefficient of traction and a traction drive fluid for use therein. More particularly, it is concerned with a process for improving the coefficient of traction at high temperatures, and a traction drive fluid for use therein, which has a good flowability at low temperatures, and a high viscosity index, and exhibits an excellent traction performance over a wide temperature range of from low temperature to high temperature.

2. Background Information

A traction drive fluid is a fluid to be used in traction drives (friction driving equipment utilizing rolling contact), such as continuously variable transmission for cars or industrial machines and hydraulic machines. In general, such traction drive fluids are required to have a high traction coefficient, a high stability against heat and oxidation and, furthermore, to be inexpensive.

In recent years, investigations have been made to reduce the size and weight of the traction drive unit, particularly for use in cars. With this miniaturization, the traction drive fluid to be used in such units has been required to have a performance high enough to be used under severe conditions, particularly to have a high traction coefficient, a suitable viscosity, and a high stability against heat and oxidation constantly over a wide temperature range of from low temperatures to high temperatures, specifically from −30° to 140° C.

The size of traction drive units is said to be inversely proportional to 0.45 powers of the traction coefficient of the traction drive fluid to be used (Technical Literature IC/FP-28R by Monsanto Company). According to this concept, the higher is the minimum traction coefficient in the temperature range in which said fluid is used, the more the miniaturization of traction drive units can be attained.

Various traction drive fluids have been proposed as in Japanese Patent Publication Nos. 338/1971 and 339/1971. These traction drive fluids, however, have failed to satisfy the abovementioned requirements, and have been involved in many problems. For example, compounds having a high traction coefficient at high temperatures produce a large agitation loss because of its poor flowability at low temperatures, and therefore, the transmission efficiency is low and the start-up property in low temperature is not sufficient. On the other hand, compounds which are of low viscosity and are excellent in transmission efficiency have a low traction coefficient at high temperatures, and as the temperature rises, their viscosities drop excessively, causing troubles in lubrication of the traction drive unit.

Furthermore, various ester compounds are disclosed in Japanese Patent Publication No. 44918/1986 as a traction drive fluid having a norbornane ring structure, but these ester compounds cannot withstand practical use, since they are very low in traction coefficients at high temperatures, and are lacking in thermal stability.

hydrogenated product of a dimer of camphene disclosed in Japanese Patent Publication No. 198693/1989 has a fairly high traction coefficient at high temperatures, but has a defect in flowability at low temperatures since it has such a high pour point as −27.5° C.

When used as a traction drive fluid, fluids having small viscosity indexes rise largely in viscosity at low temperatures, and accordingly the agitation resistance of the fluid increases causing poor start-up properties at low temperatures of a CVT (continuously variable transmission). On the other hand, at high temperatures, the viscosity of the fluid drops too suddenly to retain an appropriate lubricating oil film, which causes fatigue and damage in the traction drive units. Consequently the viscosity index of the fluid is desired to be as high as possible.

SUMMARY OF THE INVENTION

An object of the present invention is to provide a process for improving the coefficient of traction at high temperatures.

Another object of the present invention is to provide a traction drive fluid having a high flowability at low temperatures and a high viscosity index.

Still another object of the present invention is to provide a traction drive fluid which exhibits an excellent performance over a wide temperature range from low temperature to high temperature.

A further object of the present invention is to provide a traction drive fluid having the above properties in a good balance.

The present invention provides a process for improving the coefficient of traction between at least two relatively rotatable elements in a torque transmitting relationship which comprises introducing between the tractive surfaces of said elements a traction drive fluid (Fluid A) comprising as the active component a norbornane dimer represented by the general formula:

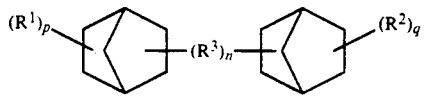

(I)

wherein $R^1$ and $R^2$ are each a hydrogen atoms or an alkyl group having 1 to 3 carbons atoms, $R^3$ indicates a methylene group, an ethylene group or a trimethylene group, any of which may have methyl groups as substituents, n indicates 0 or 1, p and q are each an integer of 1 to 3, satisfying the condition: $p+q \leqq 4$.

In the process of the present invention, a traction drive fluid (Fluid B) comprising hydrogenated dimers, trimers or tetramers of norbornanes and/or norbornenes, exclusive of polymers of cyclomonoterpenoids only, can be used in place of Fluid A.

The present invention also provides a traction drive fluid comprising Fluid A or Fluid B.

DESCRIPTION OF PREFERRED EMBODIMENTS

Figure 1:
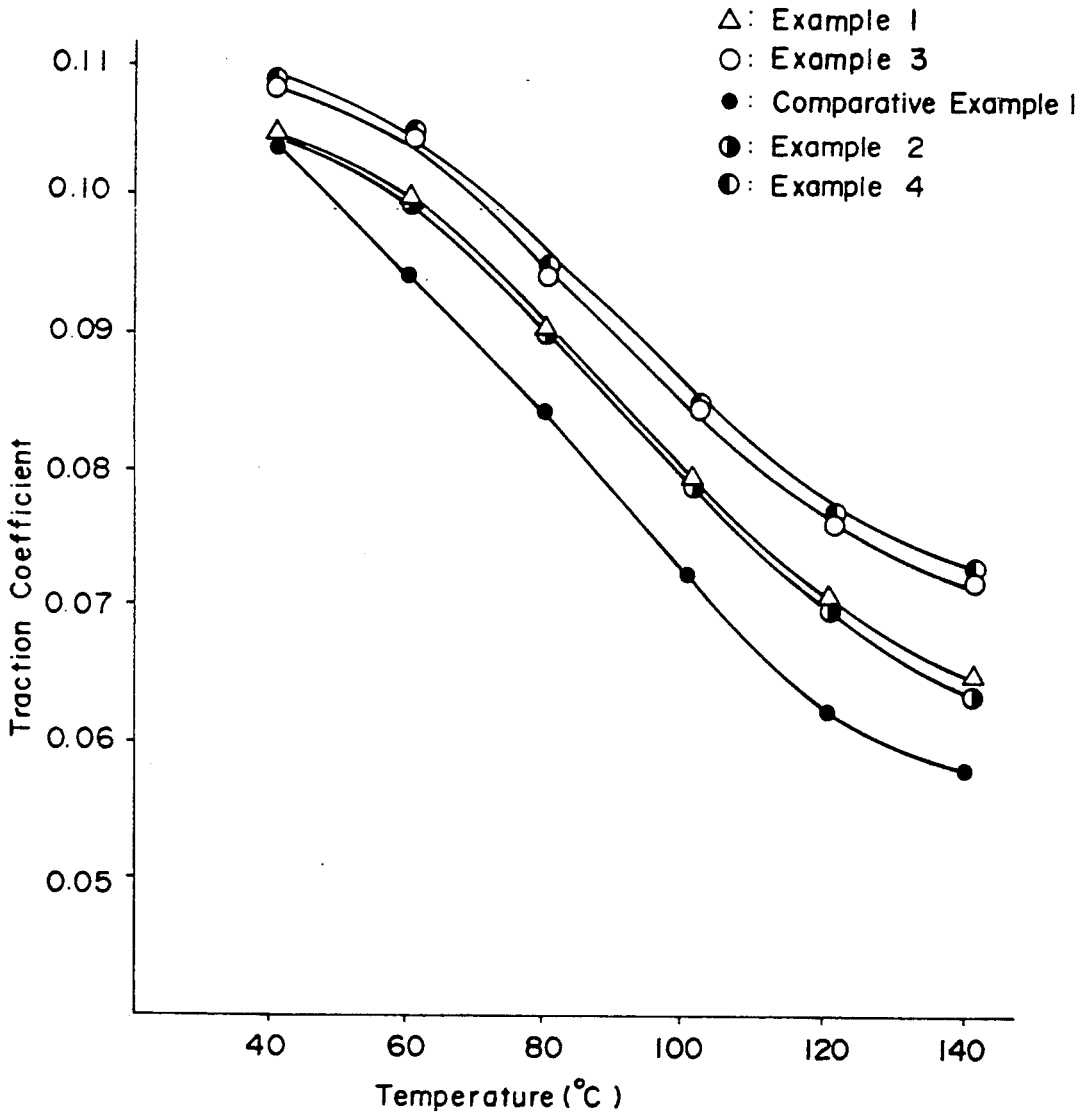
FIGS. 1 to 5 are graphs showing changes with temperature in the traction coefficient of the traction drive fluid obtained in the Examples and Comparative Examples.

The traction drive fluid (Fluid A) of the present invention contains norbornane dimers represented by the general formula (I) as described above. Said norbornane dimers are roughly classified into two types according to the number of n. When n is 0, the general formula (I) is read as:

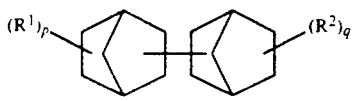

(I')

and when n is 1, it is read as:

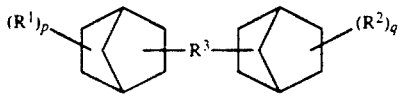

(I'')

In the general formula (I') and (I''), $R^1$ and $R^2$ are each a hydrogen atom or an alkyl group having 1 to 3 carbon atoms (a methyl group, an ethyl group, a n-propyl group, an i-propyl group), $R^3$ indicates a methylene group, an ethylene group, a trimethylene group, or those in which at least one methyl group is connected as a substituent (e.g., an ethylidene group, a methyethylene group, or a methylpropylene group), p and q are each an integer of 1 to 3, satisfying the condition: $p+q \leqq 4$.

These compounds can be obtained by various methods, and the process for producing them is not critical in the present invention. However, usually they can be produced by dimerization of norbornanes and/or norbornenes, and further by hydrogenation of the resulting dimer. The conditions for said dimerization and hydrogenation are as mentioned later. Preferred norbornanes and norbornenes are also described later.

The traction drive fluid of the present invention (Fluid A) may contain only the norbornane dimers represented by the above general formula (I). If necessary, Fluid A can contain the norbornane dimers in admixture with other traction drive fluids. Therein the amount of the norbornane dimer of the general formula (I) to be blended is not critical, and can be determined appropriately depending on the desired traction properties and types of other traction drive fluid to be blended. Usually the amount of said norbornane dimer is 5% by weight or more, preferably 30% by weight or more based on the total weight of the traction drive fluid (Fluid A).

The traction drive fluid as another embodiment of the present invention (Fluid B) contains the hydrogenated dimer, trimer, or tetramer of one or both of norbornanes and norbornenes, exclusive of polymers of cyclomonoterpenoids only. Herein norbornanes and norbornenes as the starting material to be dimerized, trimerized, or tetramerized are not critical in the present invention, and various types can be used.

Preferred norbornanes among them are those represented by the general formula:

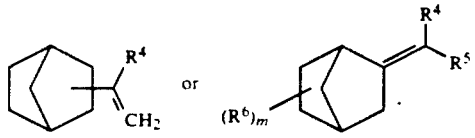

wherein, $R^4$, $R^5$ and $R^6$ are each a hydrogen atom or an alkyl group having 1 to 3 carbon atoms, preferably $R^4$, $R^5$ and $R^6$ are each a hydrogen atom or a methyl group, and m is 1 or 2. Specific examples of such norbornanes are alkenylnorbornanes such as vinylnorbornane, and isopropenylnorbornane; alkylidenenorbornanes such as methylenenorbornane, ethylidenenorbornane, isopropylidenenorbornane, 3-methyl-2-methylenenorbornane, and 3,3-dimethyl-2-methylenenorbornane.

Preferred norbornenes are those represented by the general formula:

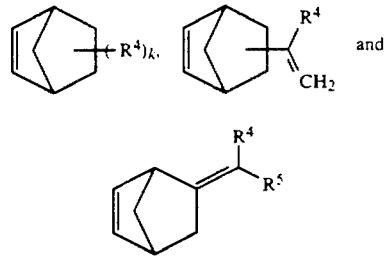

wherein $R^4$ and $R^5$ are as defined above and k is an inteqer of 1 or 2. Specific examples of these norbornenes are norbornene; alkylnorbornenes such as methylnorbornene, ethylnorbornene, isopropylnorbornene, and dimethylnorbornene; alkenylnorbornenes such as vinylnorbornene, and isopropenylnorbornene; alkylidenenorbornenes such as methylenenorbornene, ethylidenenorbornene, and isopropylidenenorbornene.

The above alkenylnorbornanes and alkylidenenorbornanes can also be obtained by hemihydrogenation of alkenylnorbornenes or alkylidenenorbornenes.

In the present invention, norbornanes and norbornenes as described above are first dimerized, trimerized or tetramerized. Herein, dimerization, trimerization or tetramerization of norbornanes or norbornenes means not only the dimerization, trimerization or tetramerization of norbornanes or norbornenes of the same kind, but also codimerization, cotrimerization or cotetramerization of norbornanes or norbornenes of different kinds. However, hydrogenated polymers of cyclomonoterpenoids only (that is, hydrogenated products of polymers prepared by (co)polymerizing one or more kinds of cyclomonoterpenoids) such as a homopolymer of camphene, homopolymer of fenchene, and copolymer of camphene and fenchene are excluded in the present invention, since they are insufficient in flowability at low temperature and viscosity index.

The abovementioned dimerization, trimerization or tetramerization of norbornanes or norbornenes is carried out usually in the presence of catalyst, and if necessary, in a solvent or a reaction controlling agent.

Various catalysts including acid catalysts and basic catalysts can be used in said dimerization, trimerization or tetramerization of norbornanes or norbornenes.

Specific examples of acid catalysts are clays such as activated clay, and acid clay; mineral acids such as sulfuric acid, hydrochloric acid, and hydrofluoric acid; organic acids such as p-toluenesulfonic acid, and triflic acid; Lewis acids such as aluminum chloride, ferric chloride, stannic chloride, boron trifluoride, boron tribromide, aluminum bromide, gallium chloride, and gallium bromide; organoaluminum compounds such as triethylaluminum, diethylaluminum chloride, and ethylaluminum dichloride; and solid acids such as zeolite, silica, alumina, silica-alumina, a cationic ion exchange resin, heteropolyacids; and so on. A suitable catalyst is selected appropriately from the viewpoint of handling or its cost. Examples of basic catalysts are organosodium compounds, organopotassium compounds, organolithium compounds, and the like. The amount of the catalyst used is not critical, and usually 0.1 to 100% by weight, more preferably 1 to 20% by weight based on the total amount of abovedescribed norbornanes and norbornenes.

In the dimerization, trimerization or tetramerization of norbornanes and norbornenes, solvents are not always required. Solvents, however, can be used for easily handling the norbornanes or norbornenes or catalyst during the reaction, or for controlling the reaction. As these solvents, most of saturated hydrocarbons such as n-pentane, n-hexane, heptane, octane, nonane, decane, cyclopentane, cyclohexane, methylcyclohexane, decalin and the like can be used. In addition, when the catalyst is of low activity, such as clays, aromatic hydrocarbons such as benzene, toluene and xylene and tetralin can be used.

A reaction controlling agent is used, if necessary, in order to favor the reaction of norbornanes or norbornenes, particularly to increase the selectivity of the dimerization, trimerization, and tetramerization reaction. As the reaction controlling agent, carboxylic acids such as acetic acid, acid anhydrides such as acetic anhydride and phthalic anhydride, cyclic esters such as γ-butyrolactone and valerolactone, glycols such as ethylene glycol, mononitro compounds such as nitromethane and nitrobenzene, esters such as ethyl acetate, ketones such as mesityl oxide, aldehydes such as formalin and acetoaldehyde, cellosolve, polyalkylene glycol alkyl ethers such as diethylene glycol monoethyl ether, and the like can be used. The amount of the reaction controlling agent used is not critical, but usually 0.1 to 20% by weight.

Dimerization, trimerization, or tetramerization is carried out in the presence of the catalyst. The conditions for reaction are determined appropriately within the range of −30° C. to 180° C. depending on the type of the catalyst, the type of additive and so on. For example when clays or zeolites are used as the catalyst, the reaction is carried out at a temperature of from room temperature to 180° C., preferably not less than 60° C. When other catalysts are used, the reaction is carried out within the temperature range of −30° C. to 100° C., preferably 0° C. to 60° C.

Then, the dimers, trimers, or tetramers of norbornanes or norbornenes thus obtained are hydrogenated, to obtain the desired hydrogenated dimer, trimer, or tetramer. Hydrogenation may be applied to the whole products of dimerization, trimerization and tetramerization, or may be applied after a part of them is fractionated or fractionally distillated.

Said hydrogenation is usually carried out in the presence of a catalyst as in the dimerization, trimerization, and tetramerization. As the catalyst, so-called hydrogenation catalysts containing at least one of metals such as nickel, ruthenium, palladium, platinum, rhodium, iridium, copper, chromium, molybdenum, cobalt and tungsten can be used. The amount of the catalyst used is 0.1 to 100% by weight, preferably 1 to 10% by weight based on the weight of the above dimers, trimers, or tetramers.

In the hydrogenation, as in the above described dimerization, trimerization, and tetramerization, a solvent can be used although it proceeds in the absence of a solvent. As the solvent, most of the liquid saturated hydrocarbons such as n-pentane, n-hexane, heptane, octane, nonane, decane, dodecane, cyclopentane, cyclohexane, and methylcyclohexane can be used. In addition, liquid compounds among aromatics, olefins, alcohols, ketones, and ethers can be used. Particularly suitable are saturated hydrocarbons.

In the hydrogenation reaction, the temperature is usually from room temperature to 300° C., and preferably from 40° to 200° C., and the pressure is from atmospheric pressure to 200 kg/cm$^2$G, preferably from atmospheric pressure to 100 kg/cm$^2$G. The hydrogenation in the present process can be carried out by the same procedure as in the usual hydrogenation.

The hydrogenated dimer, trimer or tetramer of norbornanes or norbornenes thus obtained can be used alone as the traction drive fluid (Fluid B) of the present invention, and if necessary, can be used in admixture with other traction drive fluids. In that case, the amount of the above hydrogenated dimers, trimers, or tetramers is not critical, but can be selected appropriately depending on the kinds of said hydrogenated dimers, trimers, and tetramers, or the kinds of other traction drive fluids to be blended. Usually, the preferable amount of the hydrogenated dimers, trimers, or tetramers to be contained is at least 5% by weight, preferably at least 30% by weight based on the total weight of the traction drive fluid (Fluid B). The viscosity index of the traction drive fluid is preferably not less than 0.

Other traction drive fluids to be blended with the above described hydrogenated dimers, trimers, or tetramers of norbornanes or norbornenes include various kinds of oils which are not used by themselves practically because of their low traction properties, not to mention the fluids having been used conventionally as traction drive fluids. Examples are mineral oils such as paraffin-base mineral oil, naphthene-base mineral oil and intermediate mineral oil, and a wide variety of liquid materials such as alkylbenzene, polybutene, poly-(α-olefin), synthetic naphthenes, ester and ethers. Among them, alkylbenzene, polybutene and synthetic naphthene are preferred. Synthetic naphthene includes alkane derivatives having 2 or more cyclohexane rings, alkane derivatives having at least one decalin ring and at least one cyclohexane ring, alkane derivatives having at least two decalin rings and compounds having the structure in which at least two cyclohexane rings or decalin rings are directly bonded. Specific examples of such synthetic naphthenes are 1-cyclohexyl-1-decalylethane, 1,3-dicyclohexyl-3-methylbutane, 2,4-dicyclohexylpentane, 1,2-bis(methylcyclohexyl)-2-methylpropane, 1,1-bis(methylcyclohexyl)-2-methylpropane, and 2,4-dicyclohexyl-2-methylpentane.

The traction drive fluid of the present invention contains the hydrogenated dimer of norbornane represented by the general formula (I) mentioned above (Fluid A) as an essential component, or contains hydrogenated dimers, trimers, or tetramers of norbornanes or norbornenes (Fluid B) as an essential component, and further, in some cases, other liquid material (traction drive fluid) is blended with it.

In addition, the traction drive fluid of the present invention may further contain suitable amounts of additives such as an antioxidant, a rust inhibitor, a detergent dispersant, a pour point depressant, a viscosity index improver, an extreme pressure agent, an antiwear agent, a fatigue preventing agent, an antifoam agent, an oiliness improver, a colorant and the like.

According to the present invention, a high traction coefficient can be attained over a wide temperature range of from low temperature to high temperature and a transmission efficiency is improved. As the result, miniaturization and reduction in weight of the traction drive unit, lengthening the service life of the traction drive unit, and an increase in the power of the traction drive units can be attained, and the traction drive fluid of the present invention can be used widely for various machines including continuously variable transmissions for cars or industrial machines, and further, hydraulic apparatus. In addition, it has also a high viscosity index and an excellent lubricity. Moreover, the traction drive fluid of the present invention is suitable as the lubricating oil (traction oil) of various traction drive units to be used outdoors in the winter, since it is excellent particularly in flowability at low temperature. In addition, it is very favorable in practical use because of its inexpensiveness.

The present invention is described in greater details with reference to following examples and comparative examples.

EXAMPLE 1

Four hundred grams of ethylidene norbornene and 6 g of developed Raney cobalt were placed in a 1-liter stainless steel autoclave, and hydrogenated at a temperature of 40° C. under a hydrogen pressure of 15 kg/cm$^2$G until 75 L (L=liter) of hydrogen was absorbed. After the hydrogenated product was cooled, the catalyst was filtered off. Analysis by gas chromatography (GC) and nuclear magnetic resonance (NMR) spectrum showed that the reaction product was ethylidene norbornane (purity: 98%) which was the hemihydrogenated product of the starting material.

Then, 400 g of above ethylidene norbornane and 90 g of dried activated clay (Galleon Earth NS, produced by Mizusawa Kagaku Co., Ltd.) was placed in a 1-liter three-necked flask equipped with a Dimroth reflux condenser and a thermometer, and stirred for 3 hours at 145° C. After the activated clay was filtered off from the reaction mixture, unreacted ethylidene norbornane was distilled away, and the residue was placed in a 1-liter stainless steel autoclave, and hydrogenated under a hydrogen pressure of 40 kg/cm$^2$G at a temperature of 160° C. in the presence of a nickel-diatomaceous earth catalyst (N-113, produced by Nikki Kagaku Co., Ltd.)

After the catalyst was filtered off, the residue was vacuum-distilled, to obtain 160 g of a fraction having a boiling point of 112° to 118° C./0.2 mmHG.

Analysis by mass spectrometer (MS) and NMR spectrum showed that the fraction was the hydrogenated dimer of ethylidene norbornane, that is, saturated hydrocarbon having 18 carbon atoms (molecular weight: 246) having two norbornane rings in a molecule represented by the general formula (I).

Properties of the product were as follows.

Kinematic viscosity: 24.38 cSt (40° C.), 4.027 cSt (100° C.)
Viscosity index: 21
Specific gravity (15/4° C.): 0.9735
Pour point: −42.5° C.
Refractive index ($n_D^{20}$): 1.5115

The traction coefficient of the product was measured over a temperature range of 40° C. to 140° C. The results are shown in FIG. 1.

EXAMPLE 2

The procedure of Example 1 was repeated except that, in dimerization of ethylidene norbornane, 20 cc of $BF_3 \cdot 1.5H_2O$ complex and 100 cc of methylene chloride were used instead of activated clay, and that the mixture was stirred for one hour at 10° C., and subjected to post treatment, to obtain 140 g of a fraction having a boiling point of 109° to 112° C./0.15 mn Hg. Said fraction was analyzed by MS and NMR spectrum, and the analysis showed that the fraction was the hydrogenated dimers of ethylidene norbornane, that is, saturated hydrocarbon having 18 carbon atoms containing two norbornane rings in a molecule (molecular weight: 246) represented by the general formula (I).

Properties of the product were as follows.

Kinematic viscosity: 18.87 cSt (40° C.), 3.526 cSt (100° C.)
Viscosity index: 33
Specific gravity (15/4° C.): 0.9583
Pour point: −45.0° C.
Refractive index ($n_D^{20}$): 1.5078

The traction coefficient of the product was measured over a temperature range of 40° C. to 140° C. The results are shown in FIG. 1.

EXAMPLE 3

In a 1-liter stainless steel autoclave, 400 g of vinyl norbornene and 6 g of 5% palladium-carbon catalyst were placed, and hydrogenated at a hydrogen pressure of 5 kg/cm$^2$G, at a temperature of 30° C., until 75 L of hydrogen was absorbed. The hydrogenated product was cooled, and the catalyst was filtered off. The product resulted was analyzed by GC and NMR spectrum. The analysis showed that the product was vinyl norbornane (purity: 97%) which was the hemihydrogenated product of the starting material.

Then, said vinyl norbornane was subjected to dimerization, hydrogenation and distillation in the same manner as in Example 1, to obtain 140 g of a fraction having a boiling point of 108° to 116° C./0.15 mmHg. Analysis of the fraction by MS and NMR spectrum showed that the fraction was the hydrogenated dimer of vinyl norbornane, that is, saturated hydrocarbon having 18 carbon atoms containing two norbornane rings in a molecule (molecular weight: 246) represented by the general formula (I).

Properties of the fraction were as follows.

Kinematic viscosity: 37.34 cSt (40° C.), 5.096 cSt (100° C.)
Viscosity index: 37
Specific gravity (15°/4° C.): 0.9772
Pour point: −37.5° C.
Refractive index ($n_D^{20}$): 1.5140

The traction coefficient of the product was measured over a temperature range of 40° C. to 140° C. The results are shown in FIG. 1.

EXAMPLE 4

The procedure of Example 3 was repeated except that in the dimerization of vinyl norbornane, 20 cc of $BF_3$ $1.5H_2O$ complex and 100 cc of methylene chloride were used instead of activated clay, and that the mixture was stirred for one hour at 10° C. and subjected to/post-treatment, to obtain 130 g of a fraction having a boiling point of 110° to 121° C./0.15 mmHg.

Analysis by MS and NMR spectrum showed that the fraction was the hydrogenated dimer of vinyl norbornane, that is, a saturated hydrocarbon having 18 carbon atoms containing two norbornane rings in a molecule (molecular weight: 246) represented by the general formula (I).

Properties of the product were as follows.

Kinematic viscosity: 50.30 cSt (40° C.), 5.963 cSt (100° C.)

Viscosity index: 36
Specific gravity (15°/4° C.): 0.9839
Pour point: −35.0° C.
Refractive index ($n_D^{20}$): 1.5167

The traction coefficient of the product was measured over a range of 40° C. to 140° C. The results are shown in FIG. 1.

EXAMPLE 5

The procedure of Example 4 was repeated except that 6 g of 5% ruthenium-carbon catalyst was used instead of 6 g of 5% palladium-carbon catalyst, to obtain a mixture of 30% ethyl norbornene and 70% vinyl norbornane.

Then, said mixture was subjected to dimerization, hydrogenation, and distillation in the same manner as in Example 4, to obtain 120 g of a fraction having a boiling point of 98° to 108° C./0.13 mmHg.

Analysis by MS and NMR spectrum showed that the fraction was a saturated hydrocarbon having 18 carbon atoms containing two norbornane rings in a molecule (molecular weight 246) represented by the general formula (I).

Properties of the product were as follows.
Kinematic viscosity: 35.91 cSt (40° C.), 4.900 cSt (100° C.)
Viscosity index: 23
Specific gravity (15°/4° C.): 1.0005
Pour point: −30.0° C.
Refractive index ($n_D^{20}$): 1.5205

Figure 2:
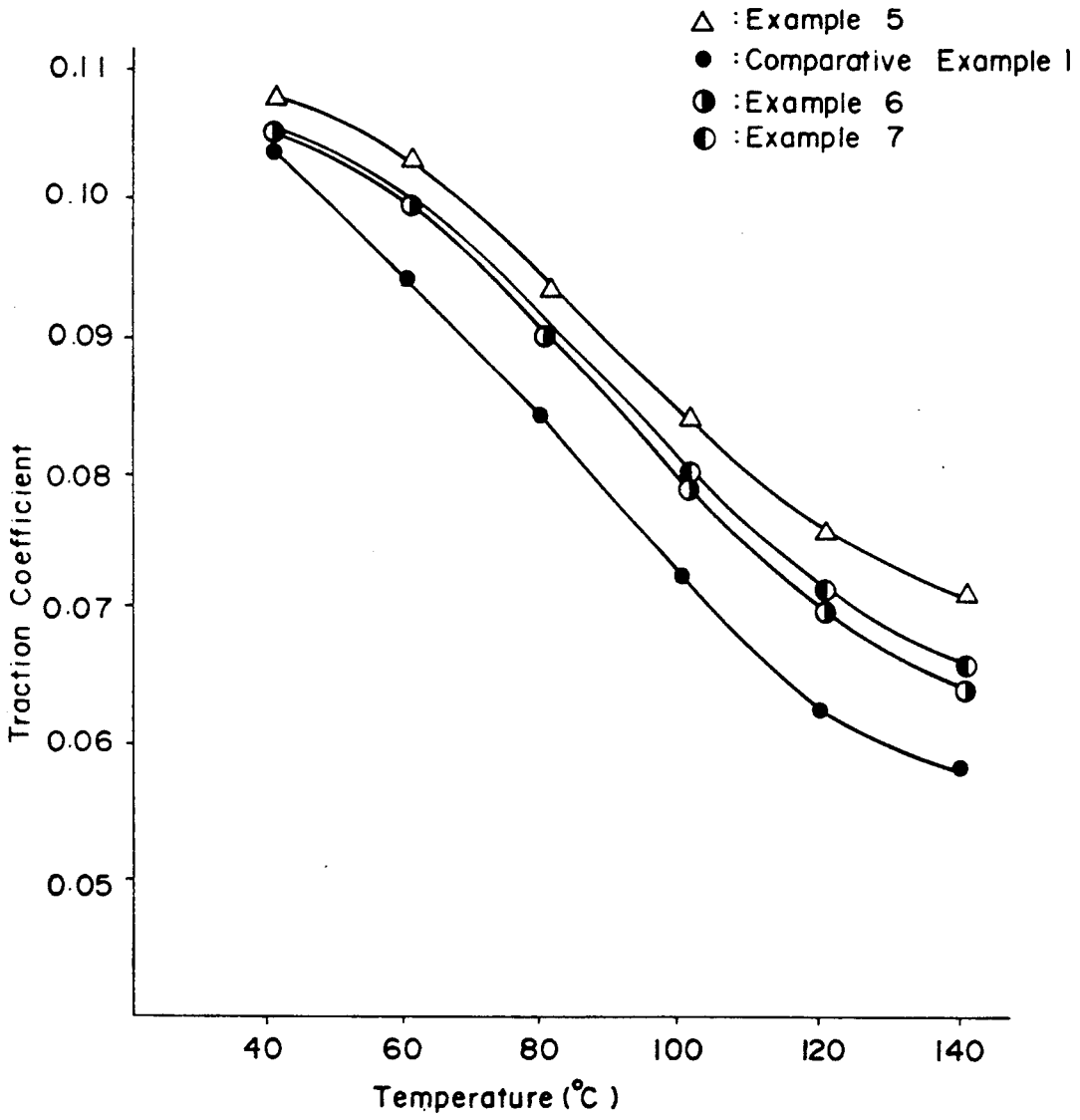

The traction coefficient of the product was measured over the temperature range of 40° C. to 140° C. The results are shown in FIG. 2.

EXAMPLE 6

In a 1-liter stainless steel autoclave in which the air was substituted with $N_2$, 3 mols of ethylidene norbornene, 0.096 mol of phenyl lithium (produced by Kanto Kagaku Co., Ltd.) and 0.2 mol of N,N,N',N'-tetramethylethylene diamine were placed, to be stirred for 6 hours at 120° to 150° C., and reacted. After completion of the reaction, the reaction product was washed with water, and dried. Unreacted ethylidene norbornene was distilled away, and the residue was hydrogenated in the same manner as in Example 1, to obtain 160 g of hydrogenated oligomer of ethylidene norbornene. Said product was analyzed by FID type gas chromatography (GC) and gas chromatography-mass spectrometer (GC-MS), and it was found that the product contained hydrogenated dimer, trimer and tetramer in the proportion of 64:30:6.

Properties of said product were as follows.
Kinematic viscosity: 64.23 cSt (40° C.), 6.576 cSt (100° C.)
Viscosity index: 18
Specific gravity (15/4° C.): 0.9757
Pour point: −37.5° C.
Refractive index ($n_D^{20}$): 1.5190

The traction coefficient of said fraction was determined over the temperature range of 40° C. to 140° C. The results are shown in FIG. 2.

EXAMPLE 7

The procedure of Example 6 was repeated except that 3 mols of vinylnorbornene was used instead of 3 mols of ethylidene norbornene, to obtain 85 g of hydrogenated dimer, trimer, tetramer of vinyl norbornene (proportion of content: 60:32:8).

Properties of said product were as follows.
Kinematic viscosity: 77.75 cSt (40° C.), 7.734 cSt (100° C.)
Viscosity index: 44
Specific gravity (15°/4° C.): 0.9724
Pour point: −32.5° C.
Refractive index ($n_D^{20}$): 1.5206

The traction coefficient of the product was determined over a temperature range of 40° C. to 140° C. The results are shown in FIG. 2.

EXAMPLE 8

The procedure of Example 3 was repeated except that methylene norbornene was used instead of vinyl norbornene, to obtain a methylene norbornane with a purity of 95%, which was the hemihydrogenated product of the starting material.

After that, the same procedure as in Example 1 was repeated except that dimerization was conducted using 162 g of methylene norbornane and 272 g of camphene, to obtain 230 g of a fraction having a boiling point of 98 to 130° C./0.1 mmHg. Analysis by MS and NMR showed that said fraction was all a saturated hydrocarbon having two norbornane rings in a molecule represented by the general formula (I) containing 39% 2-methyl-2-(2-norbornylmethyl) norbornane, 23% a compound having 18 carbon atoms, and 38% a compound having 20 carbon atoms.

Properties of said saturated hydrocarbon were as follows.
Kinematic viscosity: 27.38 cSt (40° C.), 4.345 cSt (100° C.)
Viscosity index: 32
Specific gravity (15/4° C.): 0.9619
Pour point: −45.0° C.
Refractive index ($n_D^{20}$): 1.5074

Figure 3:
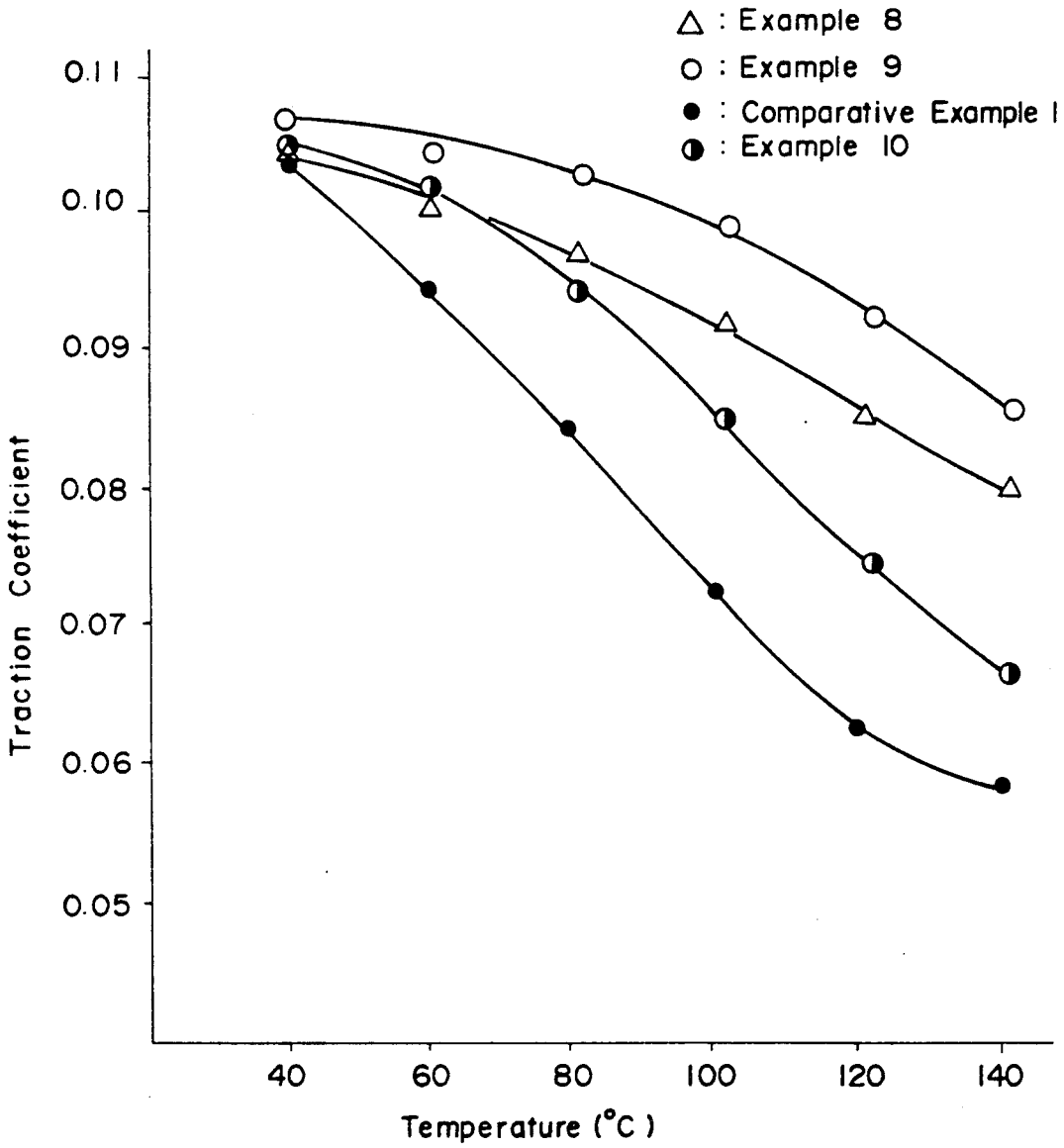

The traction coefficient of said hydrocarbon was determined over the temperature range of 40° C. to 140° C. The results are shown in FIG. 3.

EXAMPLE 9

In a 1-liter three-necked flask equipped with a Dimroth reflux condenser and a thermometer, 200 ml of cyclopentadiene and 200 ml of hexane were placed, cooled on water bath, and 200 ml of methyl vinyl ketone was added dropwise thereto while stirred over 30 minutes, and then stirred for 30 minutes, to obtain acetyl norbornene.

Successively, above reaction mixture and 1 g of 5% palladium-carbon catalyst were placed in a 1-liter stainless steel autoclave, and hydrogenated at a hydrogen pressure of 10 kg/cm$^2$G, and at room temperature.

After the reaction was completed, catalyst was filtered off, the residue was distilled, and analysis showed that the distillate was acetylnorbornane with a purity of 99%.

Next, 1 L of tetrahydrofuran solution (concentration: approximately 2 mols/liter) of methylmagnesium bromide was placed in a three-liter four-necked flask, and the mixture of 260 g of acetyl norbornane obtained above and 500 ml of ethyl ether was added dropwise while stirred. After completion of the reaction, the reaction mixture was post treated by the ordinary method, and distilled, to obtain 210 g of isopropylidene norbornane with a purity of 90%.

Lastly, the procedure of Example 2 was repeated except that isopropylidene norbornane was used instead of ethylidene norbornane, to obtain 130 g of a fraction having a boiling point of 128° to 142° C./0.1 mmHg. Said fraction was analyzed by MS and NMR, and found to be hydrogenated dimers of isopropylidene norbornane, that is, a saturated hydrocarbon having 20 carbon atoms containing two norbornane rings (molecular weight: 246) represented by the general formula (I).

Properties of said product were as follows.

Kinematic viscosity: 60.00 cSt (40° C.), 6.274 cSt (100° C.)
Viscosity index: 13
Specific gravity (15°/4° C.): 0.9677
Pour point: −30.0° C.
Refractive index ($n_D^{20}$): 1.5117

The traction coefficient of said product was determined over the temperature range of 40° C. to 140° C. The results are shown in FIG. 3.

EXAMPLE 10

Two hundred and fifty ml of decalin and 100 g of dried activated clay were placed in a 2-liter three-necked flask equipped with a Dimroth reflux condenser and a thermometer, and the mixture of 356 g of camphene, 149 g of norbornene and 100 ml of decalin was added thereto dropwise while stirred at 140° C. over three hours, and after the completion of dropping, the mixture was stirred for further three hours.

After the activated clay was filtered off from the reaction mixture, unreacted camphene was distilled away, and the residue was placed into a 1-liter stainless autoclave, and hydrogenated at hydrogen pressure of 50 kg/cm$^2$G, at a temperature of 200° C. with the use of nickel-diatomaceous earth catalyst (N-113, produced by Nikki Chemical Co., Ltd.)

After the catalyst was filtered, vacuum distillation was conducted, to obtain 180 g of a fraction having a boiling point of 105° to 117° C./0.3 mmHg. Analysis by MS and NMR spectrum, showed that said fraction was a saturated hydrocarbon having two norbornane rings in a molecule represented by the general formula (I), containing 68% of a compound having 17 carbon atoms and 32% of a compound having 20 carbon atoms.

Properties of said fraction were as follows.

Kinematic viscosity: 27.31 cSt (40° C.), 4.235 cSt (100° C.)
Viscosity index: 14
Specific gravity (15°/4° C.): 0.9596
Pour point: −37.5° C.
Refractive index ($n_D^{20}$): 1.5070

The traction coefficient of said fraction was determined over a temperature range of 40° C. to 140° C. The results are shown in FIG. 3.

COMPARATIVE EXAMPLE 1

In a 2-liter four-necked flask equipped with the same apparatus as in Example 1, 500 ml of methylcyclohexane as the solvent, 156.02 g of isoborneol and 184.01 g of triethylamine as the starting material were placed. A solution in which 146.84 g of cyclohexane carbonyl chloride was dissolved in 100 ml of methylcyclohexane was added dropwise to the mixture over 4 hours while stirred. Then, the mixture was reacted for two hours at 60° C., to complete the reaction.

Successively, the reaction mixture was cooled to room temperature, and the deposited triethylamine hydrochloride was filtered off, then the solvent and unreacted starting material were recovered by the use of a rotary evaporator, to obtain 252.51 g of residual reaction mixture. Said mixture was vacuum distilled, and 196.48 g of a fraction having a boiling point of 121° to 131° C./0.2 mmHg was obtained.

As the result of analysis by NMR, inflared ray absorption spectrum (IR), GC-MS and FID-type GC, it was found that 99% of the fraction was isobornylcyclohexane carboxylate.

Properties of the said fraction were as follows.

Kinematic viscosity: 24.04 cSt (40° C.), 3.966 cSt (100° C.)
Viscosity index: 16
Specific gravity (15/4° C.): 1.0062
Pour point: −45.0° C.
Refractive index ($n_D^{20}$): 1.4860

The traction coefficient of the product was determined over the temperature range of 40° C. to 140° C. The results are shown in FIGS. 1 to 5.

EXAMPLE 11

The procedure of Example 8 was repeated except that 162 g of methylenenorbornane was added dropwise to react with 272 g of camphene, to obtain 220 g of fraction having a boiling point of 96° to 126° C./0.09 mm Hg.

Said fraction was analyzed by MS and NMR spectrum, and the analysis showed that all of the fraction was a saturated hydrocarbon having two norbornane rings in a molecule, and represented by the general formula (I), which comprises 32% 2-methyl-2-(2-norbornylmethyl)norbornane having 16 carbon atoms, 35% compounds having 18 carbon atoms, and 33% compounds having 20 carbon atoms.

Properties of said product were as follows.

Kinematic viscosity: 24.80 cSt (40° C.), 4.042 cSt (100° C.)
Viscosity index: 17
Specific gravity (15/4° C.): 0.9606
Refractive index ($n_D^{20}$): 1.5092
Pour point: −40.0° C.

Figure 4:
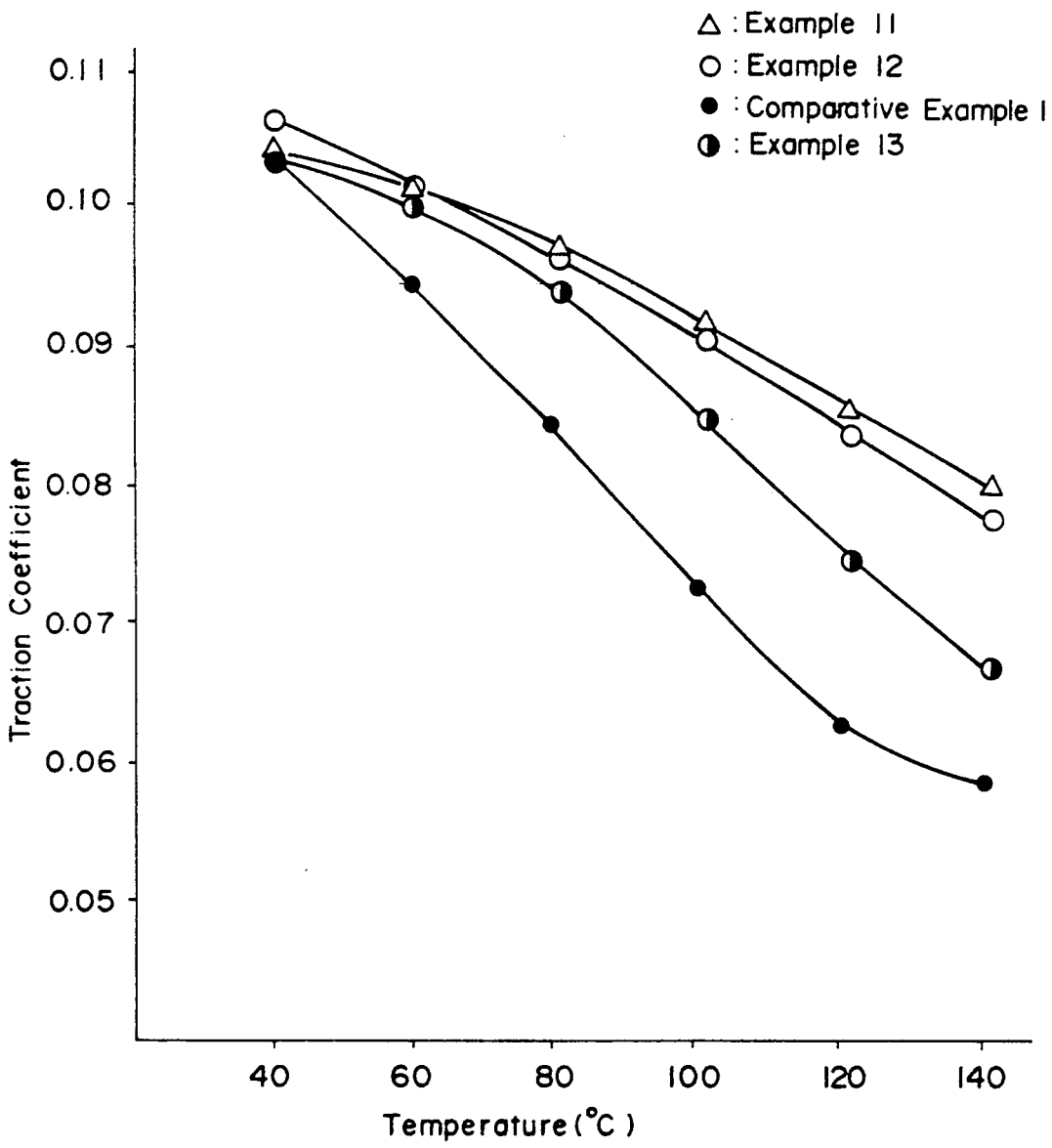

The traction coefficient of said fraction was determined over the temperature range of 40° C. to 140° C. The results are shown in FIG. 4.

EXAMPLE 12

In a 1-liter stainless autoclave, 350.5 g of crotonaldehyde (5 moles) and 198.3 g of dicyclopentadiene (1.5 moles) were placed, and reacted at 170° C. for two hours.

After the reaction mixture was cooled, 22 g of 5 % ruthenium/carbon catalyst (produced by N.E. Chemcat Co., Ltd.) was added, and was hydrogenated four hours under a hydrogen pressure of 70 kg/cm$^2$G and at a reaction temperature of 180° C. The hydrogenated product was cooled, and the catalyst was filtered off. The filtrate was vacuumdistilled, to obtain 242 g of a fraction at 70° C./0.9 mmHg. The fraction was analyzed by MS, and NMR spectrum, and the analysis showed that the fraction was 2-hydroxymethyl-3-methylnorbornane.

Subsequently, in a flow-type atmospheric reaction tube made of quart glass having outer diameter of 20 mm and a length of 500 mm, 15 g of γ-alumina (Norton Alumina SA-6273, produced by Nikka Seiko Co., Ltd.), and dehydrated at a reaction temperature of 270° C. at a weight hourly space velocity (WHSV) of 1.07 hr$^{-1}$, to obtain 196 g of dehydration product of 2-hydroxymethyl-3-methylnorbornane comprising 65% 3-methyl-2-methylenenorbornane and 28% 2,3-dimethyl-2-norbornene.

The reaction product was subjected to dimerization, hydrogenation, and distillation in the same manner as in Example 1, to obtain 116 g of a fraction having a boiling point of 126° to 128° C./0.2 mmHg.

Said fraction was analyzed by MS, and NMR spectrum, and the analysis confirmed that said fraction was a saturated hydrocarbon having 18 carbon atoms, having two norbornane rings in a molecule (molecular weight: 246), and represented by the general formula (I).

Properties of said product were as follows.

Kinematic viscosity: 22.38 cSt (40° C.), 4.007 cSt (100° C.)

Viscosity index: 52

Specific gravity (15/4° C.): 0.9630

Refractive index ($n_D^{20}$): 1.5066

Pour point: −45.0° C.

The traction coefficient of said fraction was determined over the temperature range of 40° C. to 140° C. The results are shown in FIG. 4.

EXAMPLE 13

In a 2-liter four-necked flask equipped with a Dimroth reflux condenser and a thermometer, 300 g of decalin and 40 g of dried activated clay (Galleon Earth NS, produced by Mizusawa Kagaku Co., Ltd.) were placed, and the mixture of 400 g of norbornene and 100 g of decalin was added dropwise over one hour, while stirred at 80° C., and thus norbornene was oligomerized.

The activated clay was filtered off from the reaction mixture, unreacted norbornene was distilled away, and then the residue was placed into a 1-liter autoclave made of stainless steel and hydrogenated under a hydrogen pressure of 30 kg/cm$^2$G, at 160° C. with a nickel/diatomaceous earth catalyst (N-113, produced by Nikki Kagaku Co., Ltd.)

After the catalyst was filtered off, decalin was distilled away, to obtain 220 g of hydrogenated oligomer of norbornene.

The analysis by MS and NMR spectrum showed that said oligomer was the mixture of 79% hydrogenated dimer, 18% hydrogenated trimer, and 3% hydrogenated tetramer, in which norbornane rings were bonded directly.

Properties of the product were as follows.

Kinematic viscosity: 21.42 cSt (40° C.), 3.918 cSt (100° C.)

Viscosity index: 55

Specific gravity (15/4° C.): 1.0017

Refractive index ($n_D^{20}$): 1.5196

Pour point: −45.0° C.

The traction coefficient of said fraction was determined over a temperature range of 40° C. to 140° C. The results are shown in FIG. 4.

COMPARATIVE EXAMPLE 2

In a 2-liter four-necked flask equipped with a thermometer, a Dimroth reflux condenser and a stirrer, 800 ml of dicyclopentadiene and 500 ml of 3,3-dimethylacryloyl chloride were placed, and stirred in an argon stream at 150° C. for ten hours. After the mixture was cooled to room temperature, unreacted cyclopentadiene, dicyclopentadiene and 3,3-dimethylacryloyl chloride were distilled away under reduced pressure.

Subsequently, 320 g of 6,6-dimethylbicyclo(2.2.1-)hept-2-ene-5-carbonyl chloride was fractionated out at 100° to 130° C./30 mmHg. Said fraction was added to 500 ml of 30% aqueous solution of KOH over one hour while stirred, and the hydrolysis reactor raised the temperature to 70° C. After cooled, water layer was separated, and conc hydrochloric acid in limited amount was added while stirred, to make pH 1.

Then the organic layer released was fractionated, and the water layer was extracted with ether (300 ml × two times). Further, the organic layers were collected, dried with $Na_2SO_4$, and the solvent were distilled away, to obtain 220 g of crude 6,6-dimethyl-bicyclo(2.2.1)hept-2-ene-5-carboxylic acid. Subsequently, said product was transferred to a 1-liter autoclave, and 200 ml of methylcyclohexane as solvent, 30 g of 5% palladium/carbon catalyst as the catalyst were added, and the resulting mixture was hydrogenated at a hydrogen pressure of 50 kg/cm$^2$G. The mixture began to absorb hydrogen at room temperature, and after ten minutes, when absorption of hydrogen ceased, the temperature was raised to 100° C. and kept there for one hour. After it was confirmed that no more hydrogen was absorbed, the hydrogenated product was cooled to room temperature. After the catalyst was filtered off, the residue was distilled, to obtain 180 g of (3,3-dimethylbicyclo(2.2.1-)hept-2-yl)-carboxylic acid.

Then, 150 g of said carboxylic acid was transferred to 500-ml four-necked flask, and 140 g of $SOCl_2$ was added, and acid chloride was made at 50° C. $SO_2$ and HCl gas were generated hotly. After the generation of gas was completed, excessive $SOCl_2$ was distilled away under reduced pressure.

Subsequently, in a 1-liter four-necked flask, 160 g of isoborneol, 200 ml of toluene, 200 ml of triethylamine were added, and the above mentioned acid chloride was added dropwise thereto over one hours while stirred, for esterification, then the temperature was raised from room temperature to 60° C.

Further the mixture was stirred for two hours at 90° C. After being cooled to room temperature, the deposited salt was filtered off, and the light fraction was distilled away. The residue was distilled, to obtain 210 g of (3,3-dimethylbicyclo-(2.2.1)hept-2-yl)-carboxylic acid-isobornyl ester, at 160° to 170° C./0.2 mmHg.

Properties of the said product were as follows.

Kinematic viscosity: 143.4 cSt (40° C.) 8.994 cSt (100° C.)

Viscosity index: −38

Specific gravity (15/4° C.): 1.0194

Refractive index ($n_D^{20}$): 1.4969

Pour point: +12.5° C.,

Said ester was far from being capable of being a traction drive fluid, since it has a pour point of 12.5° C. and is in a solid state at around room temperature.

COMPARATIVE EXAMPLE 3

In an 1-liter three-necked flask, 400 g of α-pinene and 300 ml of methylcyclohexane were placed, and bubbled with dried hydrochloride gas for 5 hours while stirred at 30° C., and then, the solvent was distilled away, to obtain about 500 g of bornyl chloride.

Then, in a 1-liter four-necked flask in which the air was substituted with argon, a Grignard reagent was prepared by a usual method using 25 g of magnesium piece, 5 drops of 1,2-dibromoethane, 600 ml of ethylether, and 170 g of bornylchloride.

The Grignard reagent was bubbled with carbon dioxide for 8 hours, and then the resulting mixture was poured into 1 L of aqueous solution of 30 % sodium hydroxide, to separate the organic layer and the water layer. Then, hydrochloric acid was added to the water layer, making the aqueous solution acidic, to obtain approximately 90 g of (1,1,7-trimethylbicyclo(2.2.1-)hept-2-yl)carboxylic acid which was released.

Then, into a 500-ml three-necked flask, 200 ml of methylcyclohexane, 120 g of camphene, 90 g of carboxylic acid obtained before, and 5 ml of conc sulfuric acid were placed, and stirred for 6 hours at 50° C. Then, the reaction mixture was washed with saturated brine, and an aqueous solution of 1N hydroxide, and dried with anhydrous magnesium sulfate. After the mixture was left overnight, methylcyclohexane as the solvent, unreacted camphene, and carboxylic acid were distilled away. The residue was vacuum-distilled, to obtain 85 g of fraction at 170° to 175° C./0.2 mmHg. Said (1,7,7 -trimethylbicyclo(2.2.1-)hept-2-yl)carboxylic acid isobornyl ester was in a solid state at room temperature, and not applicable as a traction drive fluid.

COMPARATIVE EXAMPLE 4

Dimerization, hydrogenation and distillation were carried out in the same manner as in Example 1 except that camphene was used instead of ethylidene norbornene, to obtain the hydrogenated dimer of camphene.

Properties of the said dimer were as follows.

Kinematic viscosity: 55.52 cSt (40° C.), 5 796 cSt (100° C.)

Viscosity index: −7

Specific gravity (15/4° C.): 0.9453

Refractive index ($n_D^{20}$): 1.5004

Pour point: −27.5° C.

By comparing the above dimer with Examples 1 to 18 of the present invention, it is clear that the compounds of the present invention are excellent in viscosity index and pour point, and accordingly have sufficient properties for practical use as traction oil for cars, through they also have two norbornane rings.

EXAMPLE 14

In a 1-liter four-necked flask equipped with a Dimorth reflux condenser and a thermometer, 300 ml of cyclopentadiene and 200 ml of n-hexane was placed, and 250 ml of methyl acrylate was added dropwise over one hour while cooled on an ice bath and stirred, and then stirred for a further 30 minutes, to obtain 2-methoxycarbonyl-5-norbornene.

Subsequently, in a 1-liter autoclave made of stainless steel, the above-mentioned reaction mixture and 10 g of 5% palladium/carbon catalyst were placed, and subjected to a hydrogenation of olefin at a hydrogen pressure of 10 kg/cm$^2$G.

After the reaction was completed, the catalyst was filtered off, and the residue was distilled. An analysis showed that the product was 2-methoxycarbonylnorbornane of purity of 98%.

Then, 350 g of the 2-methoxycarbonylnorbornane was placed into a 1-liter four-necked flask, and 500 ml of an aqueous solution of 30% potassium hydroxide was added thereto, and stirred at 40° C. for three hours to be hydrolyzed. Then the reaction mixture became homogeneous.

Said mixture was transferred to a 2 liter beaker, concentrated hydrochloric acid in a limited amount was added while cooled on a water bath, and the salt was hydrolyzed. When pH value was reached 2, the addition of hydrochloric acid was stopped, then the reaction mixture was separated into two layers. The organic layer was separated out, and the water layer was extracted with ether (200 ml×two times). The organic layers collected were added with molecular sieve 4A, and dried. Then the solvent was distilled away, to obtain 302 g of norbornane-2-carboxylic acid.

One hundred and forty-two grams of the resulting norbornane-2-carboxylic acid and one drop of DMF (dimethylformamide) were placed in a 1 liter four-necked flask, and 153 g of thionyl chloride was added dropwise over 10 minutes while stirreing. $SO_2$ gas and hydrochloride gas were generated hotly.

After being stirred at room temperature for 20 minutes, the mixture was heated to 55° C., and stirred further for 3 hours. The mixture was cooled to room temperature, then excessive thionylchloride was distilled away, and the residue was distilled, to obtain 152 g of norbornane-2-carbonylchloride.

Into a 1-liter four-necked flask, 400 g of α-pinene and 300 ml of n-hexane were placed, and bubbled with dried hydrochloride gas for 5 hours while stirred at 30° C., then the solvent was distilled away, to obtain 480 g of bornyl chloride.

In a 1-liter four-necked flask in which the air was substituted with argon gas, 33 g of magnesium piece, 2 ml of 1,2-dibromoethane, 400 ml of THF (tetrahydrofuran) and 202 g of bornylchloride were used, to prepare a Grignard reagent by a usual method.

Into a 2-liter four-necked flask, in an atmosphere of argon, 152 g of norbornane-2-carbonylchloride prepared previously was placed, 200 ml of THF was added thereto, and the mixture was stirred. After that, the Grignard reagent prepared before was added dropwise over one hour while being stirred, then the temperature was raised to 40° C. Further, the mixture was stirred for 3 hours at 60° C.

The reaction mixture was cooled to room temperature, poured little by little into 500 ml of ice water while being stirred. Further conc hydrochloric acid was added carefully, and stopped adding when pH value became 4. The water layer was extracted with ether, and the organic layers were collected, and washed two times with 200 ml of aqueous solution of 10% sodium hydrogencarbonate, and two times with 200 ml of saturated brine, and dried over anhydrous magnesium sulfate.

The solvent was distilled away, and the residue was distilled, to obtain 160 g of a fraction at 142° to 146° C./0.2 mmHg. An analysis showed that the fraction has a molecular weight of 260, and a carbonyl group, and the result of NMR spectrum showed that it was a compound having 18 carbon atoms, in which bornyl group and norbornyl group were bonded through a carbonyl group, that is, (1,7,7-trimethylbicyclo(2.2.1)hept-2-yl)-bicyclo(2.2.1)hept-2-yl)-ketone.

One hundred and fifty of ketone obtained there was placed into a 1-liter stainless steel autoclave, and 30 g of 5% ruthenium/carbon catalyst, 300 ml of methylcyclohexane as the solvent were placed, and stirred for 8 hours at 220° C., at a hydrogen pressure of 100 kg/cm$^2$G.

After the mixture was cooled to room temperature, and the catalyst was filtered away, water resulted as by-product. The solvent was distilled away and then the residue was distilled, to obtain 100 g of a fraction at 135° to 140° C./0.2 mmHg.

Analysis showed that the fraction was a compound having a molecular weight of 246 and 18 carbon atoms, in which ketone was reduced not to alcohol, but through reduced to methylene groups, that is, the fraction was (1,7,7-trimethylbicyclo(2.2.1)hept-2-yl)-(dicyclo(2.2.1)hept-2-yl)methane.

Generally, the reduction from ketone to methylene group can hardly occur only in a carbonyl group to which an aromatic ring is not adjacent. It was found, however, that in such a condition as above, the reduction can occur even where no aromatic ring exists.

Properties of the product were as follows.

Kinematic viscosity: 28.43 cSt (40° C.), 4.412 cSt (100° C.)
Viscosity index: 29
Specific gravity (15/4° C.): 0.9615
Refractive index ($n_D^{20}$): 1.4497
Pour point: −40.0° C.

Figure 5:
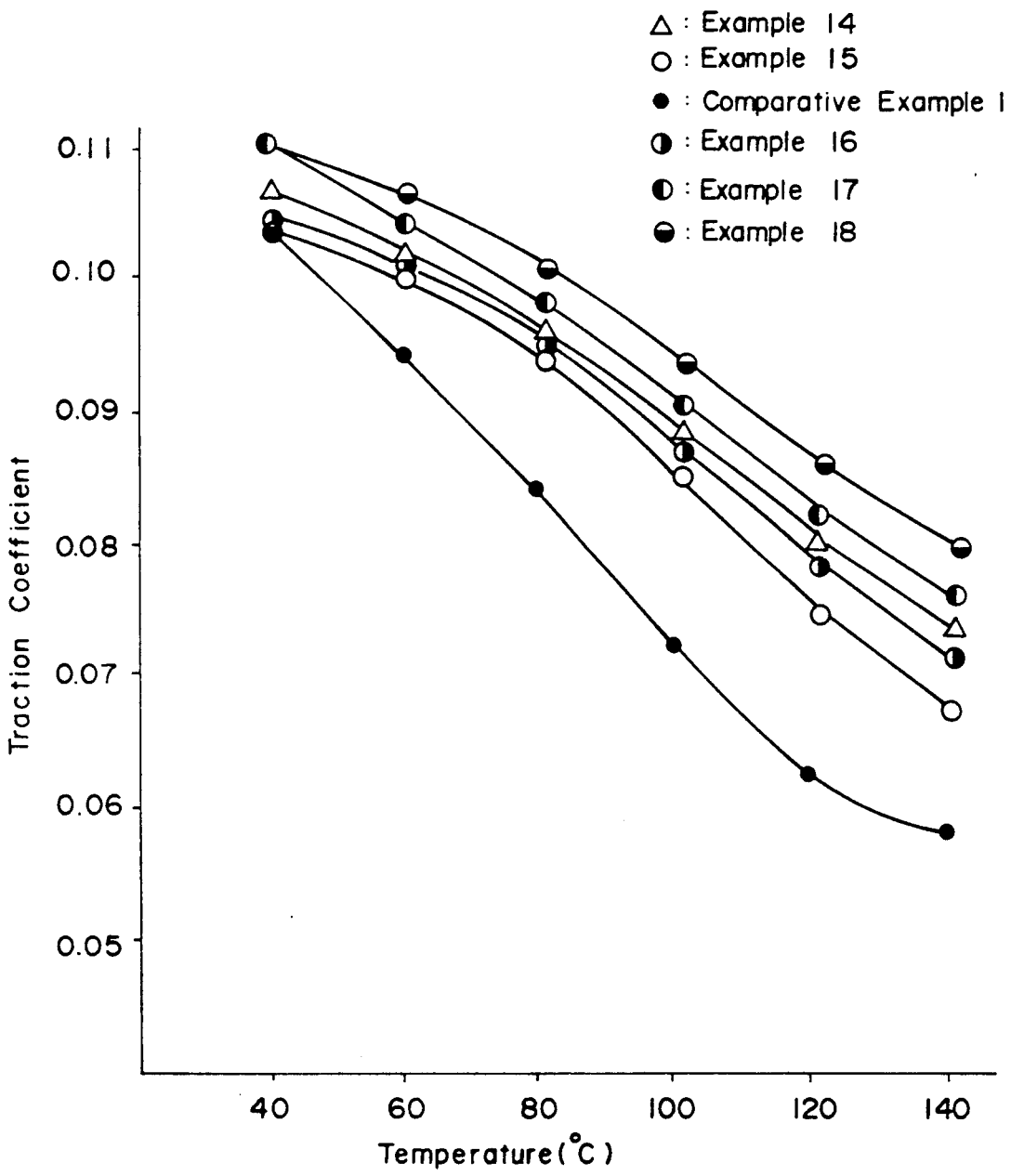

The traction coefficient of the product was determined over the temperature range of 40° C. to 140° C. The result are shown in FIG. 5.

EXAMPLE 15

The acid chloride was prepared in the same manner as in Example 14, except that commercially available 2-norbornane acetic acid was used instead of norbornane-2-carboxylic acid.

Said acid chloride was reacted with a Grignard reagent prepared in Example 14, to obtain 155 g of 2-(bicyclo(2.2.1)hept-2-yl-acetyl)-1,7,7-trimethylbicyclo(2.2.1-)heptane. The boiling point of the above-mentioned compound was 150° to 154° C./0.2 mmHg.

Subsequently, a reduction-dehydration reaction was effected in an autoclave in the same manner as in Example 14 except that the above-described compounds, that is, ketone was used, and 25 g of nickel/diatomaceous earth catalyst (N-113) was used instead of ruthenium catalyst, and 102 g of a compound in which the carbonyl group of the above compound was reduced to methylene group, that is 2-(dicyclo(2.2.1) hept-2-yl-ethyl)-1,7,7-trimethyldicyclo(2.2.1)heptane was obtained. The boiling point of said product was 142° to 147° C./0.2 mmHg, and the properties were as follows.

Kinematic viscosity: 48.18 cSt (40° C.), 5.560 cSt (100° C.)
Viscosity index: 12
Specific gravity (15/4° C.): 0.9457
Refractive index ($n_D^{20}$): 1.5003
Pour point: −35.0° C.

The traction coefficient of the above product was determined. The result is shown in FIG. 5.

EXAMPLE 16

Acid chloride was prepared in the same manner a in Example 14 except that methyl crotonate was used in place of methyl acrylate, cyclopentadiene was replaced by dicyclopentadiene, and reaction at 170° C. was carried out for 2.5 hours in an autoclave.

The resulting acid chloride was reacted with a Grignard reagent prepared in Example 14, to obtain 140 g of 1,7,7-trimethylbicyclo(2.2.1)hept-2-yl)-3-methylbicyclo(2.2.1)-hept-2-yl-ketone. The boiling point of said ketone was 152 ° to 156° C./0.2 mmHg.

Further, a dehydration-reduction reaction was carried out in the same manner as in Example 14, to obtain 98 g of a compound which resulted by reducing a carbonyl group to a methylene group, that is, (1,7,7-trimethylbicyclo(2.2.1)hept-2-yl)-(3-methyl-bicyclo(2.2.1)-hept-2-yl)methane.

Properties of the product were as follows.

Kinematic viscosity: 28.92 cSt (40° C.), 4.494 cSt (100° C.)
Viscosity index: 36
Specific gravity (15/4° C.): 0.9873
Refractive index ($n_D^{20}$): 1.4997
Pour point: −40.0° C.

The traction coefficient of the product was determined. The result is shown in FIG. 5.

EXAMPLE 17

The same procedure of Example 12 was repeated except that 2-hydroxymethyl-3-methylnorbornane was dehydrated at a reaction temperature of 330° C., and that a product containing 59% 2,3-dimethyl-2-norbornene, and 31% 3-methyl-2-methylenenorbornane was obtained, to obtain 98 g of a fraction having a boiling point of 124° to 127° C./0.2 mmHg.

Analysis by MS and NMR spectrum showed that the fraction was a saturated hydrocarbon having 18 carbon atoms (molecular weight: 246), and having two norbornane rings in a molecule, represented by the general formula (I).

Properties of the product were as follows.

Kinematic viscosity: 24.26 cSt (40° C.), 4.208 cSt (100° C.)
Viscosity index: 55
Specific gravity (15/4° C.): 0.9651
Refractive index ($n_D^{20}$): 1.5075
Pour point: −47.5° C.

The traction coefficient of the product was determined over the temperature range of 40° C. to 140° C. The result is shown in FIG. 5.

EXAMPLE 18

The procedure of Example 17 was repeated except that only $C_9$ compound as the unreacted starting material was distilled away at the last distillation, to obtain 112 g of hydrogenated oligomer of dehydration reaction product of 2-hydroxymethyl-3-methylnorbornane containing 59% 2,3-dimethyl-2-norbornene and 31% 3-methyl-2-methylenenorbornane.

The resulting product was analyzed by MS, and NMR spectrum, and the results showed that the product contained the hydrogenated dimer (molecular weight: 246) of the starting material, 6% hydrogenated trimer thereof (molecular weight : 368) and 2% hydrogenated tetramer thereto (molecular weight 490).

Properties of the product were as follows.

Kinematic viscosity: 35.96 cSt (40° C.), 5.308 cSt (100° C.)
Viscosity index: 68
Specific gravity (15/4° C.): 0.9706
Refractive index ($n_D^{20}$): 1.5098
Pour point: −37.5° C.

The traction coefficient of the above product was determined over the temperature range of 40° C. to 140° C. The results are shown in FIG. 5.

The traction coefficients in above Examples and Comparative Examples were measured by a twin disk machine. In that machine, two rollers were in contact with each other, and were of the same size. The diameter was 52 mm and the thickness was 6 mm, and the roller to be driven was in the shape of a barrel having a curvature radium of 10 mm, and the driving roller was of a flat type without crowning. One of them was rotated at a constant speed (1500 rpm), and the other was continuously rotated at a speed of from 1500 rpm to 1750 rpm. A load of 7 kg was applied by means of a spring to the contact portion of both rollers. And the tangential force, i.e., traction force caused between the two rollers, was measured, and the traction coefficient was determined. The rollers were made of bearing steel SUJ-2 with mirror polishing and the maximum Herzian contact pressure was 112 kgf/mm$^2$.

In the determination of the relations between the traction coefficient and the fluid temperature (oil temperature), oil temperature was varied from 40° C. to 140° C. by heating the oil tank by a heater, and thus the relations between the traction coefficient and the oil temperature in a slip ratio of 5% were plotted.

What is claimed is:

1. A process for improving the coefficient of traction between at least two relatively rotatable elements having tractive surfaces in a torque transmitting relationship which comprises introducing between the tractive surfaces of said elements a traction drive fluid comprising as the active component a norbornane dimer represented by the general formula:

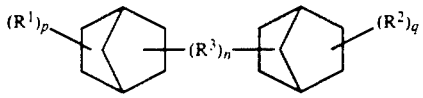

(I)

wherein $R^1$ and $R^2$ are each a hydrogen atoms or an alkyl group having 1 to 3 carbons atoms, $R^3$ indicates a methylene group, an ethylene group or a trimethylene group, any of which may have methyl groups as substituents, n indicates 0 or 1, p and q are each an integer of 1 to b 3, satisfying the condition: $p+q \leqq 4$.

2. A process for improving the coefficient of traction between at least two relatively rotatable elements having tractive surfaces in a torque transmitting relationship which comprises introducing between the tractive surfaces of said elements a traction drive fluid comprising hydrogenated dimers, trimers, or tetramers of norbornanes or norbornenes, exclusive of hydrogenated dimers, trimers and tetramers of camphene, bornylene and fenchene.

3. The process as claimed in claim 2, wherein the norbornanes are represented by the general formula:

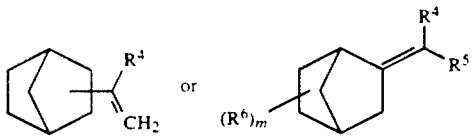

wherein $R^4$, $R^5$ and $R^6$ are each a hydrogen atom or an alkyl group having 1 to 3 carbon atoms, and m is 1 or 2.

4. The process as claimed in claim 2, wherein the norbornenes are at least one of the compounds represented by the general formulas:

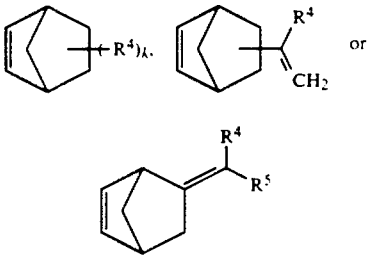

wherein $R^4$ and $R^5$ are each a hydrogen atom or an alkyl group having 1 to 3 carbon atoms, and k is an integer of 1 or 2.

5. A traction drive fluid comprising a norbornane dimer represented by the general formula:

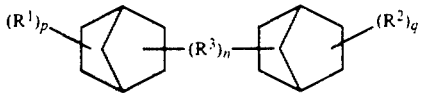

wherein $R^1$ and $R^2$ are each a hydrogen atoms or an alkyl group having 1 to 3 carbons atoms, $R^3$ is a methylene group, an ethylene group or a trimethylene group, any of which may have methyl groups as substituents, n is 0 or 1, p and q are each an integer of 1 to 3, satisfying the condition: $p+q \leqq 4$.

6. A traction drive fluid comprising the hydrogenated dimers, trimers, or tetramers of norbornanes or norbornenes, exclusive of hydrogenated dimers, trimers and tetramers of camphene, bornylene and fenchene.

7. The traction drive fluid as claimed in claim 6, wherein the norbornanes are represented by the general formula:

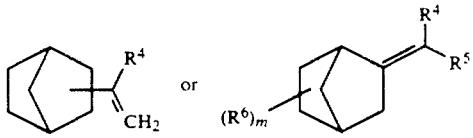

wherein $R^4$, $R^5$ and $R^6$ are each a hydrogen atom or an alkyl group having 1 to 3 carbon atoms, and m is 1 or 2.

8. The traction drive fluid as claimed in claim 6 wherein the norbornenes are at least one of the compounds represented by the general formulas:

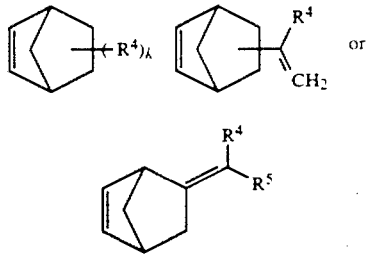

wherein $R^4$ and $R^5$ are each a hydrogen atom or an alkyl group having 1 to 3 carbon atoms, and k is an integer of 1 or 2.

9. The process as claimed in claim 1, wherein $R^3$ is selected from the group consisting of an ethylidene group, a methylethylene group and a methylpropylene group.

10. The process as claimed in claim 1, wherein the norbornane dimer is in an amount of 5% by weight of more of the traction drive fluid.

11. The process as claimed in claim 1, wherein the norbornane dimer is in an amount of 30% by weight or more of the traction drive fluid.

12. A process for improving the coefficient of traction between at least two relatively rotatable elements having tractive surfaces in a torque transmitting relationship which comprises introducing between the tractive surfaces of said elements a traction drive fluid comprising hydrogenated dimers, trimers, or tetramers of norbornanes and norbornenes, exclusive of hydrogenated dimers, trimers and tetramers of camphene, bornylene and fenchene.

13. A traction drive fluid comprising hydrogenated dimers, trimers, or tetramers of norbornanes and norbornenes, exclusive of hydrogenated dimers, trimers and tetramers of camphene, bornylene and fenchene.

14. The process as claimed in claim 2, wherein the norbornanes are selected from the group consisting of alkenylnorbornanes and alkylidenenorbornanes; the norbornenes are selected from the group consisting of norbornene, alkylnorbornenes, alkenylnorbornenes, and alkylidenenorbornenes; vinylnorbornane, isopropenylnorbornane, methylenenorbornane, ethylidenenorbornane, isopropylidenenorbornane, 3-methyl-2-methylenenorbornane and 3,3-dimethyl-2-methylenenorbornane; the norbornenes are selected from the group consisting of norbornene, methylnorbornene, ethylnorbornene, isopropylnorbornene, dimethylnorbornene, vinylnorbornene, isopropenylnorbornene, methylenenorbornene, ethylidenenorbornene and isopropylidenenorbornene; and the hydrogenated dimers, trimers or tetramers are in an amount of at least 30 weight % based on the total weight of the traction drive fluid.

15. The traction drive fluid as claimed in claim 6, wherein the norbornanes are selected from the group consisting of alkenylnorbornanes and alkylidenenorbornanes; the norbornenes are selected from the group consisting of norbornene, alkylnorbornenes, alkenylnorbornenes and alkylidenenorbornenes; and the hydrogenated dimers, trimers or tetramers are in an amount of at least 5% by weight based on the total weight of the traction drive fluid.

16. The traction drive fluid as claimed in claim 6, wherein the norbornanes are selected from the group consisting of vinylnorbornane, isopropenylnorbornane, methylenenorbornane, ethylidenenorbornane, isopropylidenenorbornane, 3-methyl-2-methylenenorbornane and 3,3-diemthyl-2-methylenenorbornane; the norbornenes are selected from the group consisting of norbornene, methylnorbornene, ethylnorbornene, isopropylnorbornene, dimethylnorbornene, vinylnorbornene, isopropenylnorbornene, methylenenorbornene, ethylidenenorbornene and isopropylidenenorbornene; and the hydrogenated dimers, trimers or tetramers are in an amount of at least 30 weight % based on the total weight of the traction drive fluid.

17. The traction drive fluid as claimed in claim 6 wherein the norbornenes are at least one of the compounds represented by the general formulas:

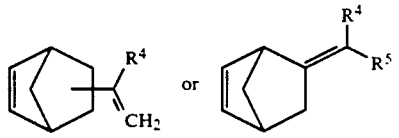

wherein $R^4$ and $R^5$ are each a hydrogen atom or an alkyl group having 1 to 3 carbon atoms, and k is an integer of 1 to 2.

18. The traction drive fluid as claimed in claim 5 wherein the traction drive fluid further comprises a second traction fluid selected from the group consisting of a paraffin-base mineral oil, a naphthene-base material oil, an intermediate mineral oil, an alkylbenzene, polybutene, poly(α-olefin), a synthetic naphthene, an ester and an ether or an additive selected from the group consisting of a detergent, a dispersant, a pour point depressant, a viscosity index improver, an extreme pressure agent, an antiwear agent, a fatigue preventing agent, an antifoam agent, an oiliness improver and a colorant.

19. The traction drive fluid as claimed in claim 6, wherein the traction fluid further comprises a second traction fluid selected from the group consisting of a paraffin-base mineral oil, a naphthene-base material oil, an intermediate mineral oil, an alkylbenzene, polybutene, poly(α-olefin), a synthetic naphthene, an ester and an ether or an additive selected from the group consisting of a detergent, a dispersant, a pour point depressant, a viscosity index improver, an extreme pressure agent, an antiwear agent, a fatigue preventing agent, an antifoam agent, an oiliness improver and a colorant.

20. The process as claimed in claim 12, wherein the traction drive fluid comprises (a) 2,3-dimethyl-2-norbornene and 3-methyl-2-methylenenorbornane, or (b) 2,3-dimethyl-2-norbornene and 3-methyl-2-methylenenorbornane.

* * * * *